US007399011B2

(12) United States Patent
Chen

(10) Patent No.: US 7,399,011 B2
(45) Date of Patent: Jul. 15, 2008

(54) HOOK DEVICE

(75) Inventor: Cheng-Chu Chen, Taipei (TW)

(73) Assignee: ASUSTeK Computer Inc., Peitou, Taipei (TW)

( * ) Notice: Subject to any disclaimer, the term of this patent is extended or adjusted under 35 U.S.C. 154(b) by 0 days.

(21) Appl. No.: 11/487,362

(22) Filed: Jul. 17, 2006

(65) Prior Publication Data

US 2007/0029816 A1 Feb. 8, 2007

(30) Foreign Application Priority Data

Jul. 19, 2005 (TW) ..... 94124408 A

(51) Int. Cl.
*E05C 17/56* (2006.01)

(52) U.S. Cl. ..... 292/251.5; 292/170

(58) Field of Classification Search ..... 292/251.5, 292/170, 140, 187; 24/303
See application file for complete search history.

(56) References Cited

U.S. PATENT DOCUMENTS 5,076,623 A * 12/1991 Richards ..... 292/251.5
5,485,733 A * 1/1996 Hoffman ..... 70/276
5,937,487 A * 8/1999 Bauer ..... 24/303
6,116,661 A * 9/2000 Overbey et al. ..... 292/92

* cited by examiner

*Primary Examiner*—Gary Estremsky
(74) *Attorney, Agent, or Firm*—Muncy, Geissler, Olds & Lowe, PLLC

(57) ABSTRACT

A hook device includes a hook base, an attractive member, a slider and a hook. The hook base includes a containing chamber, in which the containing chamber has an opening. The attractive member is set in a sidewall of the containing chamber and is opposite to the opening. The slider is disposed within the containing chamber, in which the slider has a top surface. The hook is disposed in the containing chamber and is on the top surface of the slider, in which a magnetic attractive power is induced between the hook and the attractive member. The hook may further include a secondary hook base having a hook groove corresponding to the opening. A portion of the hook is removed out through the opening of the containing chamber and is clipped in the hook groove by pushing the slider.

19 Claims, 2 Drawing Sheets

HOOK DEVICE

RELATED APPLICATIONS

The present application is based on, and claims priority from, Taiwan Application Serial Number 94124408, filed Jul. 19, 2005, the disclosure of which is hereby incorporated by reference herein in its entirety.

FIELD OF THE INVENTION

The present invention relates to a hook device, and more particularly, to a hidden hook device.

BACKGROUND OF THE INVENTION

FIG. 1 is a schematic diagram of a typical hook device, in which a hook 100 is usually exposed on the exterior of the device, and a hook tip 104 is usually sharp-pointed. When the hook 100 is put into a corresponding hook base 102, the exposed hook 100 is pressed into a hook rabbet 106 of the hook base 102, to make a connection portion 108 of the hook 100 lodge in the hook rabbet 106, so that the whole device can be joined with the hook base 102 by the hook 100, such as shown in FIG. 1. The hook 100 can be separated from the hook base 102 by removing the hook 100 from the hook rabbet 106 of the hook base 102.

However, a hook of this design impairs the device appearance, and because the hook tip 104 of the exposed connection portion 108 is sharp-pointed, the user might be accidentally injured by the hook tip 104. Thus, the aesthetics of the device is limited and the comfort of use is reduced.

SUMMARY OF THE INVENTION

Therefore, one objective of the present invention is to provide a hook device, in which a movable slider and a movable hook are used, wherein when the hook is not in operation, the hook can be hidden within a hook base such that the original design model will not be affected, the usage convenience will not be reduced, and the user will not be injured.

Another objective of the present invention is to provide a hook device, which has advantages of a great connection force and an unlimited connection depth and still be easily latched and unlatched, so that the hook device is very convenient to use.

According to the aforementioned objectives, the present invention provides a hook device comprising the following elements. A hook base includes a top plate and a first sidewall and a second sidewall on opposite sides, wherein the two sides of the top plate are respectively connected to the first sidewall and the second sidewall to form a containing chamber, and the first sidewall has an opening adjacent to the top plate. An attractive member is set in the second sidewall and is opposite to the opening. A slider is disposed and movable within the containing chamber, in which the slider has a top surface. A hook is disposed in the containing chamber and is on the top surface of the slider, in which a magnetic attractive power is induced between the hook and the attractive member.

According to a preferred embodiment of the present invention, the hook device further comprises a secondary hook base having a hook groove corresponding to the opening; wherein a portion of the hook is removed out through the opening of the containing chamber and is clipped in the hook groove by pushing the slider.

According to a preferred embodiment of the present invention, at least one of the hook and the attractive member is a magnetic attractive member. Furthermore, the hook comprises a first side surface, a second side surface, a third side surface, a fourth side surface and a fifth side surface connected in sequence. When the hook is at the clipped position, a covered area of the first side surface covered by the top plate is between one-third and one-fourth of a whole area of the first side surface.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention discloses a hook device having a hidden hook, which can increase the flexibility of the device aesthetics and can enhance the convenience and the safety in the use of the hook. In order to make the illustration of the present invention more explicit and complete, the following description is stated with reference to FIGS. 2 and 3.

Figure 1:
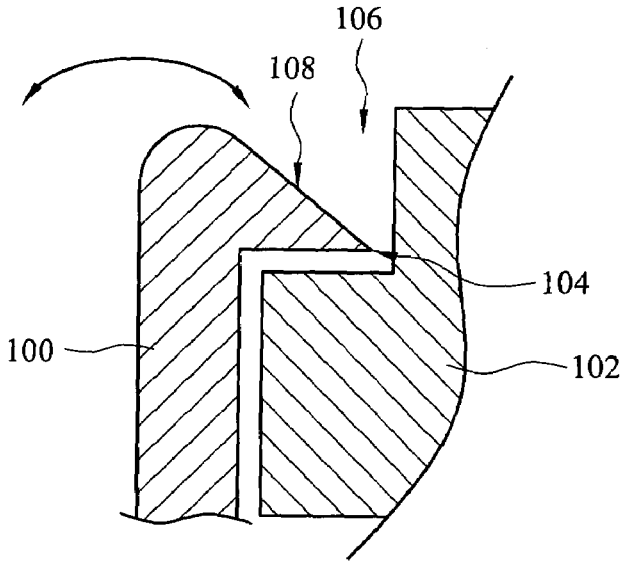
FIG. 1 (PRIOR ART)
FIG. 1 is a schematic diagram of a typical hook device.
Figure 2:
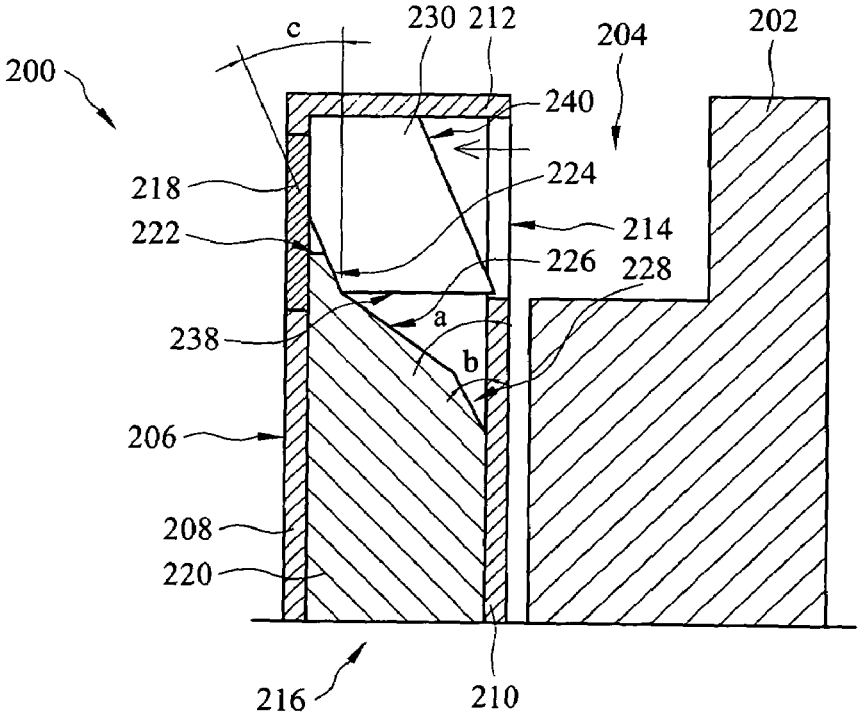
FIG. 2 is a schematic diagram of a hook device in accordance with a preferred embodiment of the present invention, wherein the hook is not in operation and is at an original position.

FIG. 2 is a schematic diagram of a hook device in accordance with a preferred embodiment of the present invention, wherein the hook is not in operation and is at an original position. The hook device 200 is mainly composed of a hook base 206, an attractive member 218, a slider 220 and a hook 230. The hook base 206 is mainly composed of a top plate 212, and a sidewall 210 and a sidewall 208 on opposite sides, in which the sidewall 210 and the sidewall 208 are respectively joined to two sides of the top plate 212 to form a containing chamber 216. The sidewall 210 of the hook base 206 includes an opening 214 adjacent to the top plate 212. The attractive member 218 is set in the sidewall 208 opposite to the opening 214.

The slider 220 is disposed within the containing chamber 216 of the hook base 206 and may slide within the containing chamber 216. The slider 220 has a top surface, in which the top surface is mainly composed of a surface region 222, a surface region 224, a surface region 226 and a surface region 228 connected in sequence. The surface region 222 is near the sidewall 208 of the hook base 206, and the surface region 228 is near the sidewall 210. In a preferred embodiment of the present invention, an included angle c between the surface region 224 and the sidewall 210 of the hook base 206 is preferably between about 5° and 55°, and is more preferably between about 15° and 45°; an included angle a between the surface region 226 and the sidewall 210 is preferably between about 30° and 55°, and is more preferably about 45°; and an included angle b between the surface region 228 and the sidewall 210 is preferably between about 10° and 50°, and is more preferably between about 20° and 40°, such as shown in FIG. 2.

The hook 230 includes a side surface 232, a side surface 234, a side surface 236, a side surface 238 and a side surface 240 connected in sequence, in which the side surface 232 is adjacent to the top plate 212 of the hook base 206. As shown in FIG. 2, when the hook 230 is not in operation and is at an original position, the hook 230 is connected with the sidewall 208 of the hook base 206, the side surface 234 of the hook 230 is adjacent to the sidewall 208, and the side surface 236 is adjacent to the surface region 224 of the slider 220. In the present invention, a magnetic attractive power is induced between the hook 230 and the attractive member 218. At least one of the hook 230 and the attractive member 218 is a magnetic attractive member, such as a magnet, or both of the hook and the attractive member are magnetic attractive members.

Figure 3:
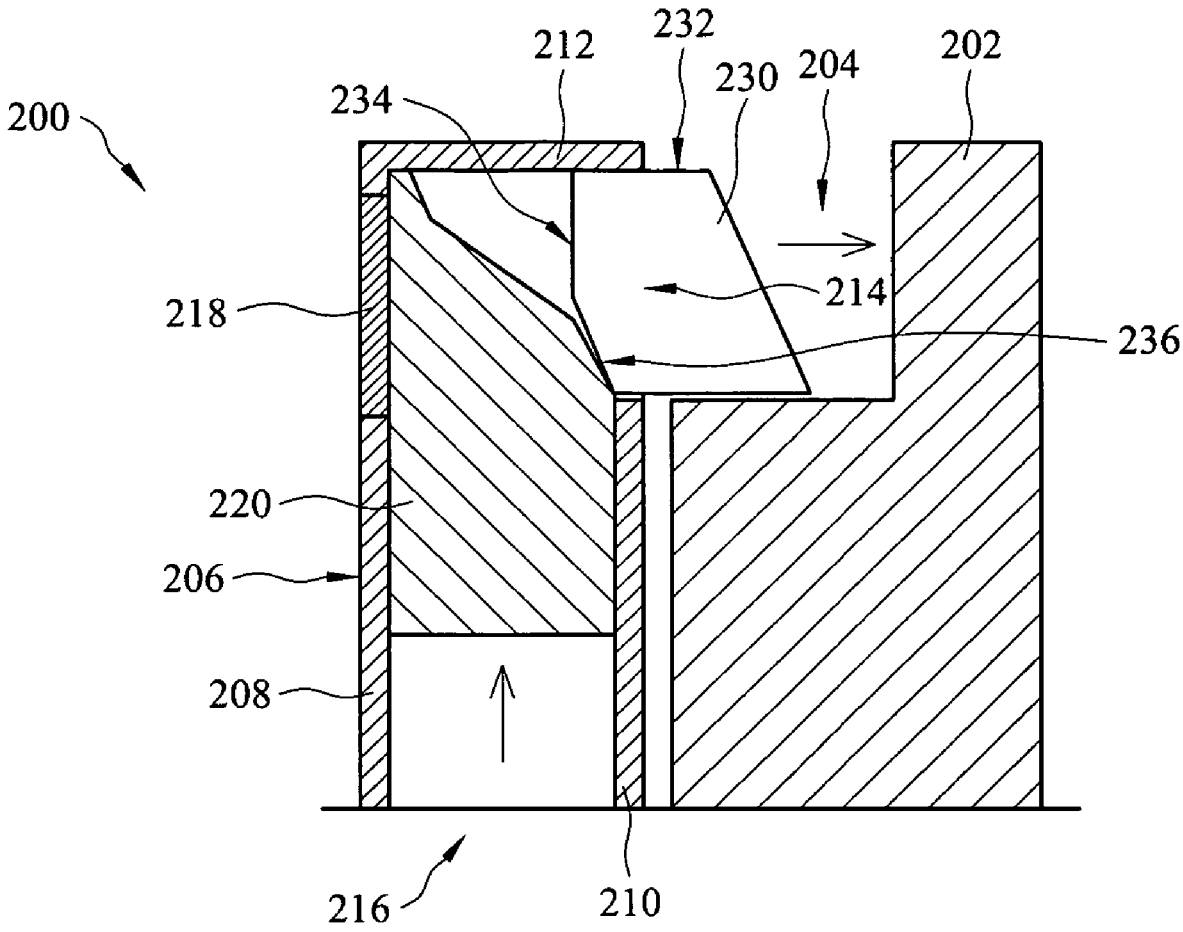
FIG. 3 is a schematic diagram of a hook device in accordance with a preferred embodiment of the present invention, wherein the hook is in operation and is at a clipped position.

The hook device 200 may further include a secondary hook base 202. The secondary hook base 202 corresponds to the hook base 206, in which the secondary hook base 202 has a hook groove 204 corresponding to the opening 214 of The hook base 206. When the hook 230 is at The original position and is hidden within the hook base 206, an external force is applied to push the slider 220 to move upwardly and push the hook 230. With The top surface design of multi-stage surface regions, the hook 230 is pushed out of The opening 214 of The hook base 206 to the hook groove 204 of the secondary hook base 202, so as to make a portion of the hook 230 outside of the opening 214 and disposed in the hook groove 204, such as shown in FIG. 3. Then, the hook 230 is at a clipped position and is held by the slider 220 to produce an end-thrust force on the hook 230, so as to make the hook 230 effectively clipped in the hook groove 204. When the hook 230 is at the clipped position, the side surface 238 is connected with a sidewall of the hook groove 204, such as shown in FIG. 3. In a preferred embodiment of The present invention, when The hook 230 is at the clipped position, a portion of the hook 230 still remains in the containing chamber 216, and a covered area of the side surface 232 of the hook 230 covered by the top plate 212 is between one-third and one-fourth of a surface area of the side surface 232.

When the hook 230 is required to retreat from the secondary hook base 202, the slider 220 simply needs to be retreated. Then, the end-thrust force applied to the hook 230 by the slider 220 is removed, and the hook 230 is pulled toward the sidewall 208 by the magnetic attractive power between the hook 230 and the attractive member 218, so that the hook 230 is separated from the secondary hook base 202 and is successively retreated back into the hook base 206 to be hidden within the containing chamber 216.

One feature of the present invention is to use a movable slider to push a moveable hook and to provide a coordination design between a top surface of the slider and a hook structure, so that a hidden hook device is obtained with advantages including easy latching and unlatching, great connection force and a wide range of clipping depth. Accordingly, the hook device of the present invention is suitable for a typical routine-work machine, and is more suitable for a device requiring frequent detaching, such as a removable hard disk or a charger base of a mobile phone.

According to the aforementioned description, one advantage of the hook device of the present invention is that a movable slider and a movable hook are used, and when the hook is not in operation, the hook is hidden within the hook base. Therefore, with the hidden hook, the original design model will not be affected and the user will not be injured, and thereby can further enhance convenience and safety in use.

According to the aforementioned description, the hook device of the present invention has advantages of a great connection force and a wide range of connection depth. Besides, the hook device is easily latched and unlatched, so that the hook device is very convenient in use and has wide applicability.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A hook device, comprising:

a hook base including a first sidewall and a second sidewall on opposite sides, and a top plate, wherein two sides of the top plate are respectively connected with the first sidewall and the second sidewall to form a containing chamber, and the first sidewall has an opening adjacent to the top plate;

an attractive member set in the second sidewall and opposite to the opening;

a slider disposed and movable within the containing chamber, wherein the slider has a top surface;

a hook disposed in the containing chamber and on the top surface of the slider, wherein a magnetic attractive power is induced between the hook and the attractive member; and a secondary hook base having a hook groove corresponding to the opening; wherein a portion of the hook is removed out through the opening of the containing chamber and is clipped in the hook groove by pushing the slider.

2. The hook device according to claim 1, wherein the top surface of the slider comprises a first surface region, a second surface region, a third surface region and a fourth surface region connected in sequence, wherein the first surface region is near the second sidewall, and the fourth surface region is near the first sidewall.

3. The hook device according to claim 2, wherein an included angle between the second surface region and the first sidewall is between about 15° and 45°.

4. The hook device according to claim 2, wherein an included angle between the third surface region and the first sidewall is between about 30° and 55°.

5. The hook device according to claim 2, wherein an included angle between the third surface region and the first sidewall is about 45°.

6. The hook device according to claim 2, wherein an included angle between the fourth surface region and the first sidewall is between about 20° and 40°.

7. The hook device according to claim 2, wherein the hook comprises:

a first side surface adjacent to the top plate;

a second side surface, wherein when the hook is at an original position, the hook is connected with the second sidewall, and the second side surface is adjacent to the second sidewall;

a third side surface, wherein when the hook is at the original position, the third side surface is adjacent to the second surface region of the slider;

a fourth side surface, wherein when the hook is at a clipped position, the fourth side surface is connected with a sidewall of the hook groove; and a fifth side surface, connected in sequence.

8. The hook device according to claim 7, wherein when the hook is at the clipped position, a covered area of the first side surface by the top plate is between one-third and one-fourth of a surface area of the first side surface.

9. The hook device according to claim 1, wherein the attractive member and/or the hook is a magnetic attractive member.

10. A hook device, comprising:

a hook base including a containing chamber, wherein the containing chamber has an opening;

an attractive member set in a sidewall of the containing chamber and opposite to the opening;

a slider disposed within the containing chamber, wherein the slider has a top surface;

a hook disposed in the containing chamber and on the top surface of the slider, wherein a magnetic attractive power is induced between the hook and the attractive member; and a secondary hook base having a hook groove corresponding to the opening; wherein a portion of the hook is removed out through the opening of the containing chamber and is clipped in the hook groove by pushing the slider.

11. The hook device according to claim 10, wherein the containing chamber is composed of a first sidewall and a second sidewall on opposite sides, and a top plate, and the opening is set in the first sidewall and is adjacent to the top plate.

12. The hook device according to claim 11, wherein the top surface of the slider comprises a first surface region, a second surface region, a third surface region and a fourth surface region connected in sequence, wherein the first surface region is near the second sidewall, and the fourth surface region is near the first sidewall.

13. The hook device according to claim 12, wherein an included angle between the second surface region and the first sidewall is between about 15° and 45°.

14. The hook device according to claim 12, wherein an included angle between the third surface region and the first sidewall is between about 30° and 55°.

15. The hook device according to claim 12, wherein an included angle between the third surface region and the first sidewall is about 45°.

16. The hook device according to claim 12, wherein an included angle between the fourth surface region and the first sidewall is between about 20° and 40°.

17. The hook device according to claim 12, wherein the hook comprises:

a first side surface adjacent to the top plate;

a second side surface, wherein when the hook is at an original position, the hook is connected with the second sidewall, and the second side surface is adjacent to the second sidewall;

a third side surface, wherein when the hook is at the original position, the third side surface is adjacent to the second surface region of the slider;

a fourth side surface, wherein when the hook is at a clipped position, the fourth side surface is connected with a sidewall of the hook groove; and a fifth side surface, connected in sequence.

18. The hook device according to claim 17, wherein when the hook is at the clipped position, a covered area of the first side surface by the top plate is between one-third and one-fourth of a surface area of the first side surface.

19. The hook device according to claim 10, wherein the attractive member and/or the hook is a magnetic attractive member.

* * * * *